US006558208B2

(12) United States Patent
Suzuki

(10) Patent No.: US 6,558,208 B2
(45) Date of Patent: May 6, 2003

(54) ELECTRICAL CONTACT FOR PRESS-BONDING TO ELECTRICAL WIRE

(75) Inventor: Mitsuru Suzuki, Kanagawa (JP)

(73) Assignee: Tyco Electronics Amp, K.K., Kanagawa (JP)

( * ) Notice: Subject to any disclaimer, the term of this patent is extended or adjusted under 35 U.S.C. 154(b) by 45 days.

(21) Appl. No.: 09/846,672

(22) Filed: May 1, 2001

(65) Prior Publication Data

US 2001/0039153 A1 Nov. 8, 2001

(30) Foreign Application Priority Data

May 8, 2000 (JP) ..... 2000-135120

(51) Int. Cl.[7] ..... H01R 4/10
(52) U.S. Cl. ..... 439/878; 439/852
(58) Field of Search ..... 439/877, 878, 439/881, 882, 842, 843, 845, 846, 847, 849, 851, 852, 854, 855

(56) References Cited

U.S. PATENT DOCUMENTS

| | | | | | |
|---|---|---|---|---|---|
| 1,703,325 | A | * | 2/1929 | Smarr | 439/877 |
| 3,051,773 | A | * | 8/1962 | Batcheller | 174/94 R |
| 3,120,990 | A | * | 2/1964 | Kinkaid | 439/855 |
| 3,656,093 | A | * | 4/1972 | Kinkaid | 439/872 |
| 4,385,794 | A | * | 5/1983 | Lucius | 439/399 |
| 4,405,189 | A | * | 9/1983 | Douty et al. | 439/399 |
| 4,840,578 | A | * | 6/1989 | Sato | 439/395 |
| 5,302,146 | A | * | 4/1994 | Yamamoto | 439/877 |
| 5,599,214 | A | * | 2/1997 | Sakai et al. | 439/877 |
| 6,099,360 | A | | 8/2000 | Broschard, III et al. | 439/748 |

FOREIGN PATENT DOCUMENTS

| | | | |
|---|---|---|---|
| GB | 878154 | 9/1961 | |
| GB | 1 281 198 | 7/1972 | H01R/11/08 |

* cited by examiner

*Primary Examiner*—Tulsidas Patel

(57) ABSTRACT

An electrical contact for attachment to an insulated wire includes an insulator crimp section (11) having a pair of insulation engaging arms (12*a*, 12*b*) which are offset from each in an axial direction of the wire. The insulation engaging arms include facing edges (38*a*, 38*b*) which are arranged to contact each other along a spiral track when the insulation engaging arms are press-bonded to the insulation of the wire. Inside beveled surfaces (18*a*, 18*b*) and outside beveled surfaces (28*a*, 28*b*) serve to guide the insulation engaging arms into position and to facilitate sliding contact between the facing edges (38*a*, 38*b*) during the press-bonding. The inside beveled surfaces (18*a*, 18*b*) also provide a gap (4B) which serves as a relief area for compressed insulation. As a result of the press-bonding, the insulation engaging arms (12*a*, 12*b*) are formed into an integral unit and are strongly fastened to the insulation of the electrical wire.

5 Claims, 6 Drawing Sheets

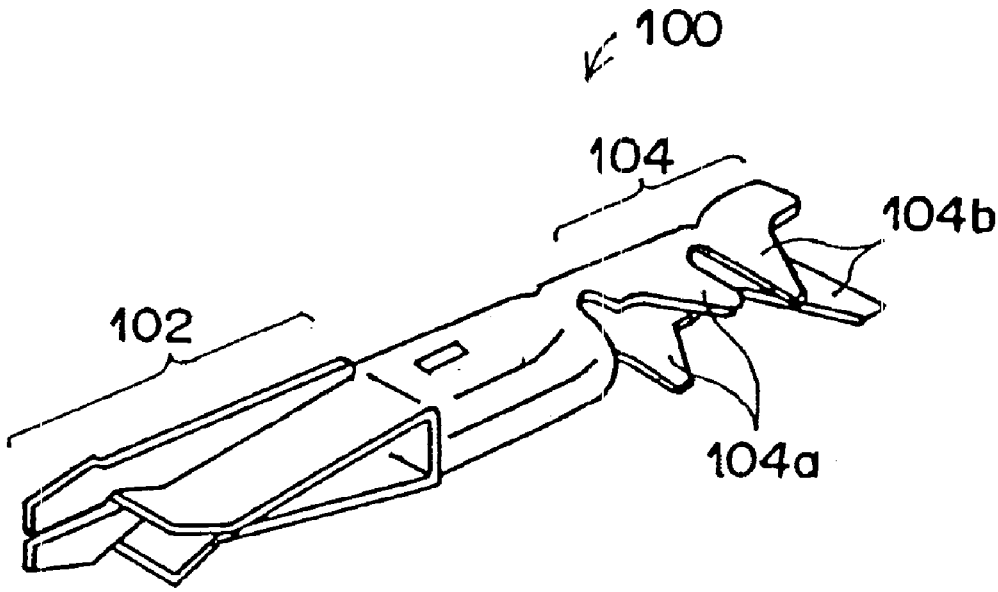
PRIOR ART Fig. 7

ELECTRICAL CONTACT FOR PRESS-BONDING TO ELECTRICAL WIRE

BACKGROUND OF THE INVENTION

The present invention relates to an electrical contact and a method for press-bonding [this] electrical contact to an electrical wire.

DESCRIPTION OF THE PRIOR ART

Electrical contacts having wire retaining barrels engage and maintain an electrical wire therein are generally known in the art. One example of such an electrical contact, which is disclosed in Japanese Utility Model Application Kokoku No. S45-33001, is shown in FIG. 7. This electrical contact 100 has a contact part 102 that electrically contacts a mating electrical contact (not shown in the figures), and a wire retention part 104 that is connected by bending the barrel around the outer circumference of an electrical wire (not shown in the figures). The wire retention part 104 is constructed from a pair of conductor barrels 104*a*, 104*a* which are bent about the core of the wire and frictionally engage the core wire, i.e., the conductor of the electrical wire. A pair of insulator barrels 104*b*, 104*b* are also provided and are bent about the outer covering of the wire and frictionally engage the outer covering, i.e., the insulation of the electrical wire. The conductor barrels 104*a*, 104*a* are formed so that their positions are offset relative to each other in the axial direction of the electrical contact 100. The insulator barrels 104*b*, 104*b* are also formed so that their positions are offset relative to each other in the axial direction of the electrical contact 100. The barrels are bent or press-bonded so that they envelop and frictionally engage the electrical wire from both sides of the electrical wire, thus pressing and fastening the outer covering of the electrical wire in place with the broadest possible area.

Furthermore, an electrical contact in which beveled surfaces are formed on the tip ends of the insulator barrels that are press-bonded or frictionally engaged to the outer covering of the electrical wire is disclosed in Japanese Utility Model Application Kokai No. S56-119264.

The barrel parts 104*b*, 104*b* of the electrical contact 100 disclosed in the above-mentioned Japanese Utility Model Application Kokoku No. S45-33001 are separated from each other in the axial direction of the electrical contact 100 after the barrels have been bent; accordingly, these barrel parts 104*b*, 104*b* are wrapped around the circumference of the outer covering of the electrical wire without contacting each other. As a result, the electrical contact 100 can be used on wires of various diameters, and the total length of the electrical contact 100 can be made relatively short. However, the pair of barrel parts 104*b*, 104*b* have no structural integrity following bending or press-bonding; consequently, the barrel parts 104*b*, 104*b* tend to open, so that the frictional engagement with the wire is weak, thereby allowing the wire to be inadvertently removed causing electrical failure.

Furthermore, in the latter prior art example, there are limits on the diameter of the electrical wires that can be used. Moreover, there is a danger that the tip ends of the insulator barrel will strike each other and bite into the outer covering of the electrical wire creating the possibility of damage to the outer covering of the electrical wire.

SUMMARY OF THE INVENTION

The present invention was devised to solve the above referenced problems. Consequently, the invention provides a compact electrical contact which has a high press-bonding strength while facilitating a broad range of applicable electrical wire diameters.

The electrical contact of the present invention has an electrical contact part, a conductor barrel that is press-bonded to or in frictional engagement with the core wire of an electrical wire, and an insulator barrel that is press-bonded to or in frictional engagement with the insulating covering of the electrical wire. The insulator barrel is constructed from a pair of left and right press-bonding parts disposed in positions that are offset relative to each other in the axial direction of the electrical wire. The electrical contact is constructed so that when the press-bonding parts are press-bonded to the electrical wire, the facing edges of the press-bonding parts, which face each other in the axial direction, contact each other on the electrical wire.

Both surfaces of the facing edges of the press-bonding parts may be subjected to swage working. Alternatively, the entire circumferences of only the inside surfaces of the press-bonding parts may be subjected to swage working. Or the entire circumferences of the outside surfaces may be subjected to swage working in addition to the entire circumferences of the inside surfaces.

The term "both surfaces of the facing edges" refers to both the inside surfaces of the facing edge parts of the plate members that form the press-bonding parts, i.e., the surfaces that contact the outer covering of the electrical wire when press-bonding is performed, and the outside surfaces of the facing edge parts, i.e., the surfaces that can be seen from the outside following press-bonding.

The term "entire circumference" does not necessarily refer strictly to the entire circumference of each press-bonding part; this term also refers to cases in which the area in the vicinity of the fixed end of each press-bonding part is not included in this circumference.

The shapes of the tip end portions of the press-bonding parts and the shapes of the corresponding portions that face these tip end portions during the press-bonding of the press-bonding parts may be complementary shapes. In addition to cases in which the shapes of the entire tip end portions of the press-bonding parts and the shapes of the corresponding portions of the electrical contact are shapes that are complementary to each other, the term "complementary" also includes cases in which the shapes of only portions of the tip end portions and the shapes of the corresponding portions are shapes that are complementary to each other.

The electrical wire press-bonding method using the electrical contact of the present invention is also described. When the electrical contact is press-bonded to the electrical wire, the pair of press-bonding parts make sliding contact with each other at the facing edges of said press-bonding parts, so that the respective tip ends of the press-bonding parts move while describing portions of a spiral track along the outer circumference of the aforementioned electrical wire.

BRIEF DESCRIPTION OF THE DRAWINGS

FIG. 4(B) is a front view.

FIG. 5 are partial enlarged views similar to those of FIG. 4 showing the electrical contact press-bonded to a small-diameter electrical wire.

FIG. 6 are partial enlarged sectional views of the press-bonding parts along line 6—6 in FIG. 4(B).

FIG. 7 is a perspective view which shows one example of a conventional electrical contact according to the prior art.

DETAILED DESCRIPTION OF THE PREFERRED EMBODIMENT

Figure 1:
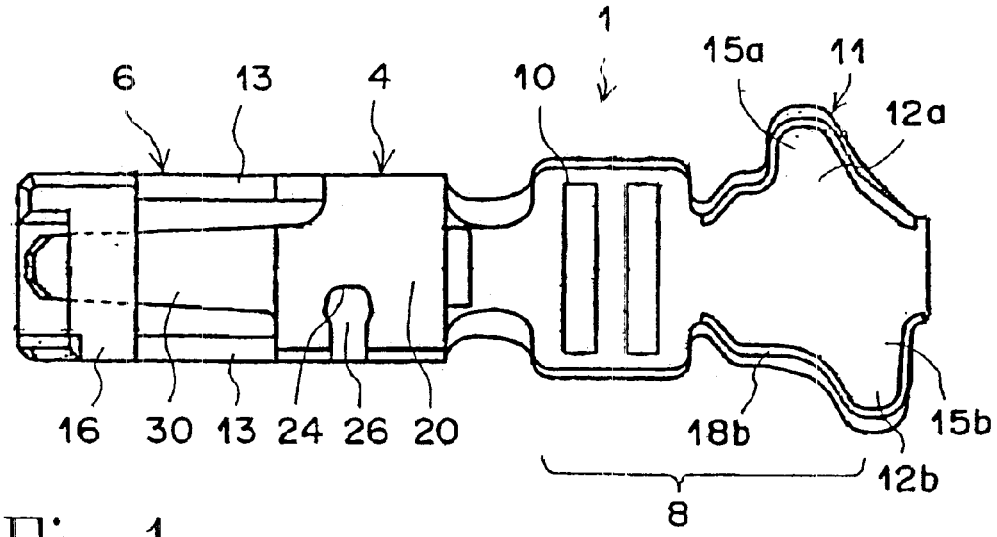
FIG. 1 is a plan view of an electrical contact of the present invention.
Figure 2:
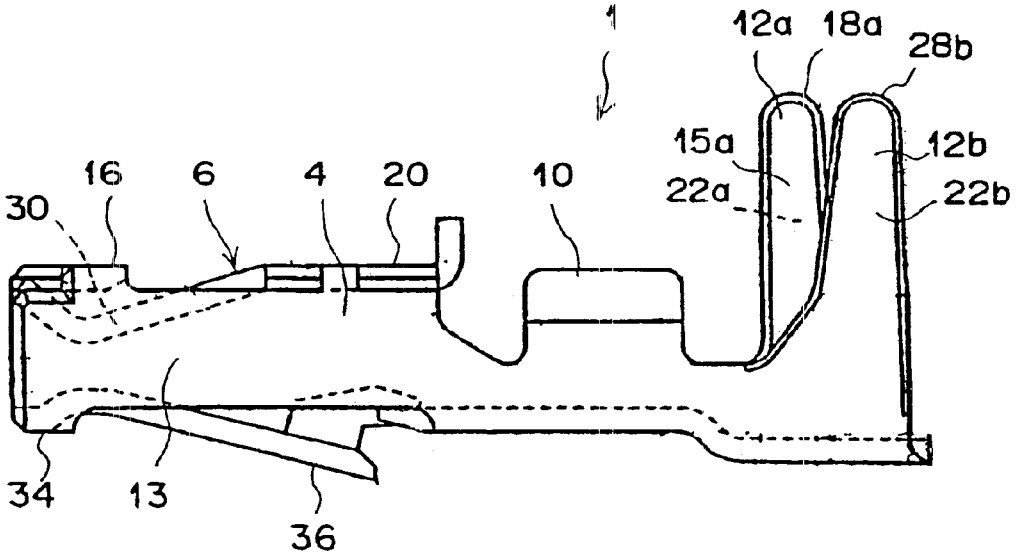
FIG. 2 is a front view of the electrical contact shown in FIG. 1.
Figure 3:
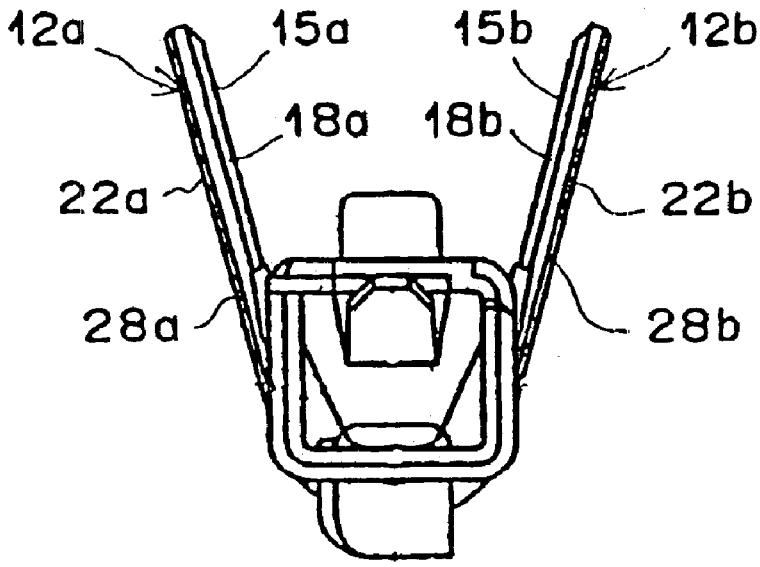
FIG. 3 is a side view of the electrical contact shown in FIG. 1.

The contact 1 is formed by stamping and bending a single metal plate. The contact main body 4 is substantially box-shaped, and has a pin receiving section 6 in front, and a wire termination section 8 in the rear. The wire termination section 8 has a conductor crimp section 10 and an insulator crimp section 11. The main body 4 has a set of side walls 13 that extend parallel to each other. The side walls 13 extend from the main body 4 to the pin receiving section 6. A bridge or partial top wall 16 is formed on the front end portion of a first respective side wall 13. The bridge extends from the respective side wall to the other side wall, such that the side walls 13 are bridged by this bridge 16. In the rear portion of the main body 4, a connecting member 20 extends from the upper edge of the other side wall 13, and forms a bridge to the first respective side wall 13. A cut-out 24 is formed in the connecting member 20. A tongue 26, which has a shape that is complementary to the shape of the cut-out 24, protrudes from the first respective side wall 13. The side walls 13 are connected as a result of the engagement of the tongue 26 with the cut-out 24.

A resilient contact section 30 extends from the connecting member 20 toward the interior of the pin receiving section 6 along the longitudinal axis of the contact 1. A lance 36, pushed out by means of a press mold (not shown in the figures), is formed as an integral part of a bottom wall 34 of the pin receiving section 6 opposite the resilient contact section 30.

The conductor crimp section 10, which is formed as an integral part of the main body 4 at the rear of the main body 4, is fastened to a core wire or conductor 52 (FIG. 4) of wire 50 or to a core wire or conductor 62 (FIG. 5) of wire 60 by crimping or any other known means of terminating a conductor to a terminal. The insulator crimp section 11 is formed to the rear of the conductor crimp section 10. The insulator crimp section 11 has a pair of insulator engaging arms 12*a* and 12*b* whose positions are offset relative to each other in the axial direction of the contact 1. These insulator engaging arms 12*a* and 12*b* are fastened by crimping or press-bonding to the outer insulation covering 54 (FIG. 4) of the wire 50 or the insulation covering 64 (FIG. 5) of the wire 60.

As best shown in FIG. 6, the inner circumferential edges of the insulation engaging arms 12*a* and 12*b* are swaged or work hardened to create inside beveled surfaces 18*a* and 18*b* on the interior surface 15*a* and 15*b* thereof. The surfaces 15*a* and 15*b* engage the insulation covering 54 or 64. Furthermore, the outer circumferential edges of the insulation engaging arms 12*a* and 12*b* are swaged or work hardened to create outside beveled surfaces 28*a* and 28*b* on the outside surfaces 22*a* and 22*b* of the insulation engaging arms 12*a* and 12*b*.

Figure 4C:
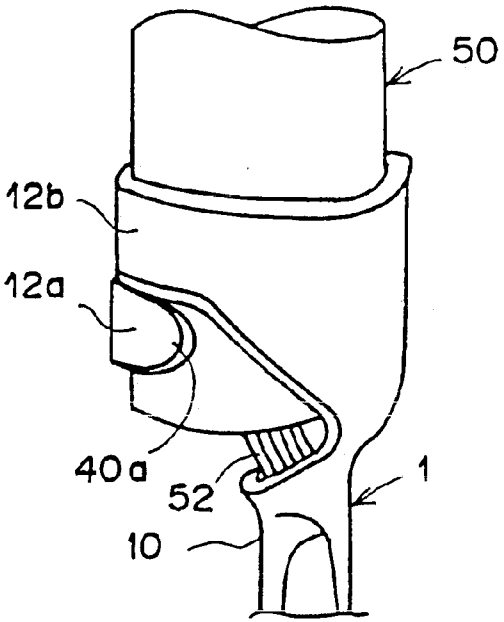
FIG. 4(C) is a side view of the opposite side.
Figure 4:
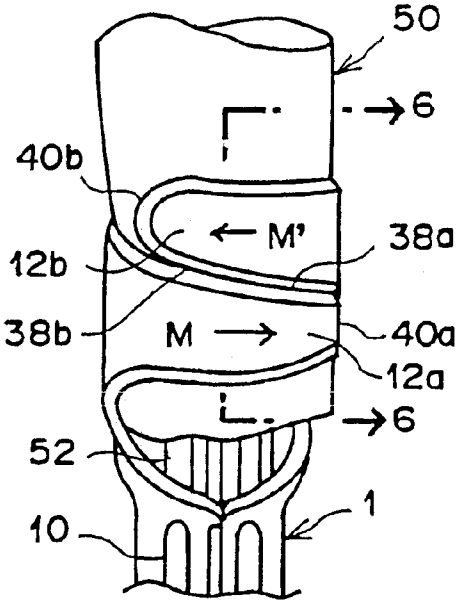
FIG. 4 are partial enlarged views showing the electrical contact press-bonded to a large-diameter electrical wire.
Figure 4A:
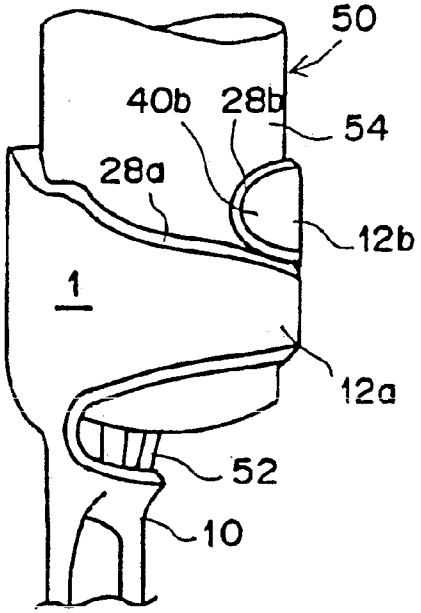
FIG. 4(A) is a side view of the press-bonded parts.

As is shown in FIG. 4, the outer covering 54 of the electrical wire 50 is press-bonded or crimped by the insulation engaging arms such that the outer covering 54 is captured from both sides by the insulation engaging arms 12*a* and 12*b*. The core wire 52 is crimped and electrically connected by the conductor crimp section 10. When pressure from a crimping force is applied to the insulation engaging arms 12*a* and 12*b*, the respective facing edges 38*a* and 38*b*, that are positioned facing each other in the axial direction, contact each other as shown in FIG. 4(B). As crimping is performed, the facing edges 38*a* and 38*b* move in opposite directions as indicated by the arrows M and M' while making sliding contact with each other. Since the insulation engaging arms 12*a* and 12*b* are tapered from the tip end portions 40*a* and 40*b* to the fixed ends of the insulation engaging arms, the insulation engaging arms 12*a* and 12*b* move in opposite directions in the axial direction of the electrical wire 50 while making sliding contact with each other. In this case, the tip end portions 40*a* and 40*b* describe portions of a spiral track along the outer circumference of the electrical wire 50. As a result, the insulator engaging arms 12*a* and 12*b* are formed into an integral unit, and are fastened by crimping or press-bonding to the electrical wire 50. Since the electrical wire 50 has a large diameter, the tip end portions 40*a* and 40*b* of the respective press-bonding parts 12*a* and 12*b* do not reach the edges of corresponding portions (described later) of the contact 1, as is shown in FIGS. 4(A) and 4(C).

Figure 5C:
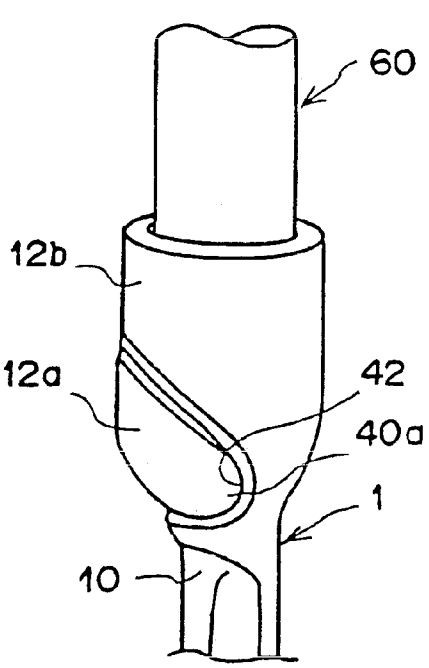
FIG. 5(C) is a side view of the opposite side.
Figure 5B:
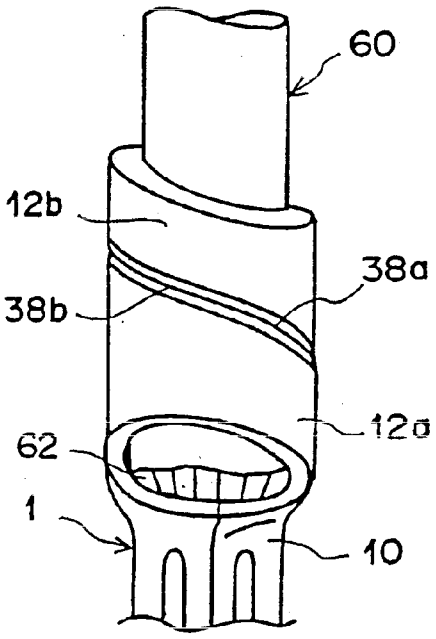
FIG. 5(B) is a front view.

In the case of a small-diameter wire 60, as is shown in FIG. 5, the insulator engaging arms 12*a* and 12*b* are completely wrapped around the circumference of the electrical wire 60. As is shown in FIG. 5, the insulator engaging arms 12*a* and 12*b* are wrapped further around the outer circumference of the electrical wire 60 than the arms are in the case of the electrical wire 50. Accordingly, the range in which the facing edges 38*a* and 38*b* make sliding contact is greatly increased. Furthermore, the respective insulator engaging arms 12*a* and 12*b* are further displaced in opposite directions along the axial line of the electrical wire 60, so that the electrical wire 60 is firmly held in position, In this embodiment, the tip end portion 40*a* of the insulator engaging arm 12*a* is positioned in the first corresponding portion 42 of the contact 1. This first corresponding portion 42 is located in a transition area between the insulator engaging arm 12*b* and the conductor crimp section 10, and has a curved shape that is complementary to the shape of the tip end portion 40*a*. The tip end portion 40*a* fits precisely into the first corresponding portion 42, so that movement of the tip end portion 40*a* into and away from the outer insulation covering 64 is prevented. As a result, damage to the outer covering 64 of the electrical wire 60 that might be caused by the tip end portion 40*a* of the insulator engaging arm 12*a* moving inward and biting into the outer covering 64, as well as an increase in the external dimensions of the contact 1 that might be caused by the tip end portion 40*a* moving outward, can be prevented. Furthermore, the tip end portion 40*a* and first corresponding portion 42 make surface contact with the electrical wire 60 as an integral unit, so that strong press-bonding or crimping is accomplished.

Figure 5A:
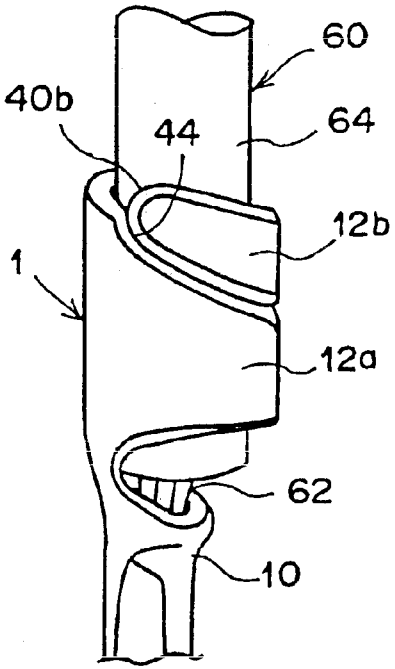
FIG. 5(A) is a side view of the press-bonded parts.

As is shown in FIG. 5(A), a second corresponding portion 44 that corresponds to the tip end portion 40*b* of the insulator engaging arm 12*b* is at the rear end of the contact 1. A part of the second corresponding portion 44 has a complementary shape to the conductor engaging arm 12*b*.

Figure 6A:
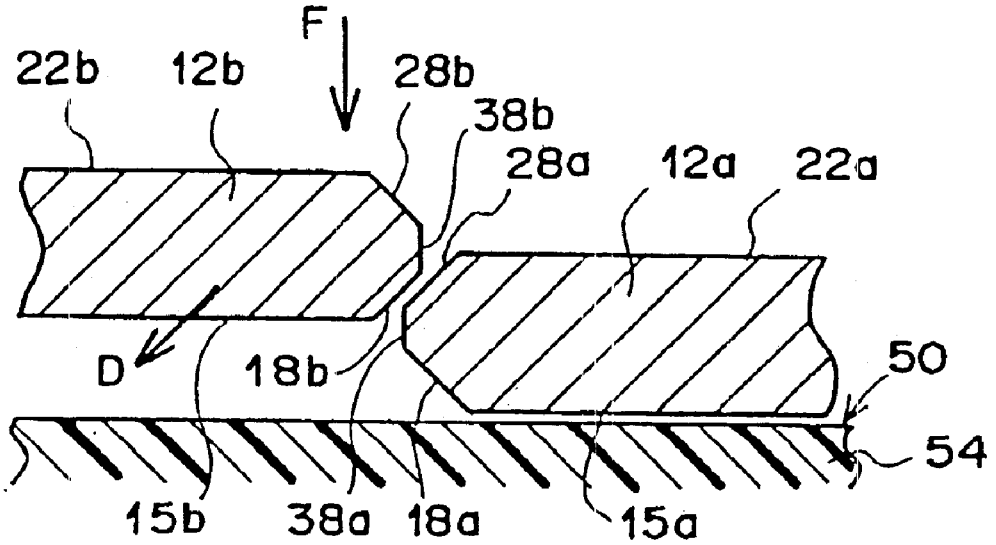
FIG. 6(A) shows a state in which the press-bonding parts are overlapped.
Figure 6B:
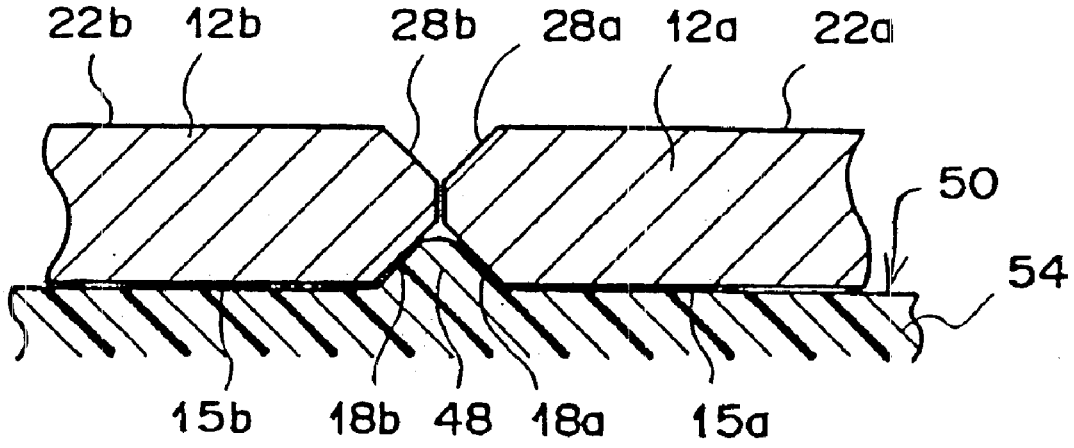
FIG. 6(B) shows a state in which the press-bonding parts are properly press-bonded.

In a case where the facing edge 38*b* of the insulator engaging arm 12*b* rides over the facing edge 38*a* of the insulation engaging arm 12*a* as shown in FIG. 6(A), if a pressing force used for the purpose of press-bonding or crimping is applied from above in the direction indicated by the arrow F, the inside beveled surface 18*b* slips over the outside beveled surface 28*a*, so that the insulator engaging arm 12*b* moves diagonally downward in the direction indicated by the arrow D. As a result, the insulator engaging arm 12*b* is moved to the position shown in FIG. 6(B). Since the inside beveled surfaces 18*a* and 18*b* facing the insulation covering 54 of the wire 50 are both tapered with respect to the insulation covering 54 in a direction away from the insulation covering 54, the insulator engaging arms 12*a* and 12*b* are prevented from biting into the insulation covering 54 during the crimping process. Furthermore, in the engaged state, as in shown in FIG. 6(B), a portion of the insulation covering 54 that is displaced due to the compression caused by the press-bonding enters a gap 48 formed between the inside beveled surface 18*a* and the inside beveled surface 18*b* . As a result, the insulator engaging arm 12*a* and 12*b* and the insulation covering 54 engage with each other in an interlocking state, thus preventing relative movement of the electrical wire 50 and contact 1. The same is true in the case of the small-diameter wire 60.

The present invention is described in detail with reference to the embodiments shown in the drawings. However, these embodiments are illustrative and the invention is not limited to such embodiments. For example, it would also be possible to swage only the inside surface of each of the insulation engaging arms 12*a* and 12*b*, and to omit swaging on the outside surfaces. The corrective effect such as that shown in FIG. 6(A) can be obtained in this case as well.

Furthermore, in regard to the electrical contact of the present invention, a female-type contact is described in the embodiment; however, invention can also be used in a male-type contact.

Advantageously, when the pair of insulator engaging arms are disposed in positions that are offset relative to each other in the axial direction of the electrical wire and are crimped or press-bonded to the electrical wire, the facing edges of the insulator engaging arms contact each other and contact the electrical wire. Accordingly, the press-bonding strength can be increased by forming the pair of insulator engaging arms into a unit that has structural integrity while maintaining a broad range of applicable electrical wire diameters. Furthermore, since the facing insulator engaging arms are not separated by a gap in the axial direction of the electrical wire, the dimension of the electrical contact in the axial direction can be shortened, so that a compact connector can be obtained.

Furthermore, in a case where both surfaces of the facing edges of the insulator engaging arms are subjected to swage working, even if the insulator engaging arms should overlap each other in the swage-worked areas, the insulator engaging arms will be caused to move laterally in the mutual swage-worked areas by the pressing force during press-bonding, so that the insulator engaging arms are corrected to the proper position. Accordingly, overlapping of the insulator engaging arms is prevented, so that an increase in the external dimensions of the electrical contact can be avoided.

Furthermore, if the entire circumference of the inside surface of each insulator engaging arm is subjected to swage working, the gaps formed in the swage-worked areas act as relief areas for the compressed insulation covering. This prevents the insulator engaging arms from biting into or damaging the insulation covering. This is especially effective in the case of electrical wires that are superior in terms of flexibility but easily damaged, e.g., electrical wires with an outer covering made of silicone, etc., that extend to the back side of the display screen in notebook-type personal computers.

Furthermore, if the entire circumference of the outside surface of each insulator engaging arm is subjected to swage working, flash generated on the outside surface is eliminated. Accordingly, when the electrical contact is inserted into the cavity of a connector housing, there is no interference between the inside walls of the cavity and such flash, so that the insertion of the electrical contact can be smoothly accomplished.

Furthermore, if the shape of the tip end portions of the insulator engaging arms and the shape of the corresponding portions that are contacted by these tip end portions during the crimping or press-bonding of the insulation engaging arms are complementary in shape, then sliding contact between the insulation engaging arms can be smoothly accomplished. The tip end portions are prevented from movement toward or away from the wire. Specifically, since there is no protrusion of the tip end portions of the insulation engaging arms, an increase in the external dimensions of the contact can be prevented.

In the electrical wire crimping or press-bonding method using the electrical contact of the present invention, the pair of insulation engaging arms, that are press-bonded when the electrical contact is press-bonded to the electrical wire, make sliding contact with each other at the facing edges of the insulation engaging arms. In so doing, the respective tip ends of the insulation engaging arms move while describing portions of a spiral track along the outer circumference of the electrical wire. Accordingly, an increase in the contact area with the electrical wire is smoothly accomplished along with the formation of the insulation engaging arms into an integral unit, so that a contact that has a large press-bonding strength and a small dimension in the axial direction is obtained.

I claim:

1. An electrical contact for attachment to an electrical wire having an insulation covering that surrounds a conductive core, the electrical contact comprising:

a pin receiving section, a conductor crimp section that is arranged to be press-bonded to the conductive core of the electrical wire, and an insulator crimp section that is arranged to be press-bonded to the insulation covering of the electrical wire, the insulator crimp section including a pair of insulation engaging arms disposed in positions that are offset relative to each other in an axial direction of the electrical wire, each of the insulation engaging arms having an inside surface, an outside surface, and a facing edge, such that when the insulation engaging arms are press-bonded to the electrical wire, the inside surfaces engage the insulating covering, and the facing edges contact each other in the axial direction, and each of the insulation engaging arms having an inside beveled surface adjacent to its said facing edge.

2. The electrical contact of claim 1, wherein each of the insulation engaging arms has an outside beveled surface adjacent to its said facing edge.

3. The electrical contact of claim 1, wherein the inside beveled surfaces are continuous along their entire circumferential length.

4. The electrical contact of claim 2, wherein the outside beveled surfaces are continuous along their entire circumferential length.

5. The electrical contact of claim 1, wherein tip end portions of the insulation engaging arms and corresponding portions that face the tip end portions when the insulation engaging arms are press-bonded have complementary shapes.

* * * * *